US007406754B2

(12) United States Patent
Trail

(10) Patent No.: US 7,406,754 B2
(45) Date of Patent: Aug. 5, 2008

(54) COMBINED HEADSTONE AND COLUMBARIUM

(76) Inventor: Nancy Trail, 5750 James Dr., Stevensville, MI (US) 49127

( * ) Notice: Subject to any disclaimer, the term of this patent is extended or adjusted under 35 U.S.C. 154(b) by 54 days.

(21) Appl. No.: 11/300,235

(22) Filed: Dec. 14, 2005

(65) Prior Publication Data

US 2007/0130736 A1 Jun. 14, 2007

(51) Int. Cl.
*A61G 17/00* (2006.01)

(52) U.S. Cl. ..... 27/1; 52/103

(58) Field of Classification Search ..... 27/1; 40/124.5; 52/103–104; D99/19
See application file for complete search history.

(56) References Cited

U.S. PATENT DOCUMENTS

| | | | | | |
|---|---|---|---|---|---|
| D89,766 | S | | 5/1933 | Hull | |
| 1,982,432 | A | | 11/1934 | Hull | |
| 2,075,859 | A | * | 4/1937 | Martin | 52/38 |
| 2,124,143 | A | | 7/1938 | Long | |
| 3,726,052 | A | * | 4/1973 | Thompson | 52/103 |
| D259,369 | S | | 5/1981 | Splendora | |
| 4,337,109 | A | | 6/1982 | Narita | |
| 4,521,999 | A | * | 6/1985 | Flanagan | 52/103 |
| 5,371,984 | A | * | 12/1994 | Taylor | 52/103 |
| 5,408,786 | A | * | 4/1995 | Konno | 52/128 |
| 5,546,710 | A | | 8/1996 | Barry | |
| 5,729,921 | A | | 3/1998 | Rojas | |
| 5,732,515 | A | | 3/1998 | Rodrigues et al. | |
| 5,987,720 | A | * | 11/1999 | Yamamoto | 27/35 |
| 6,076,292 | A | | 6/2000 | Kawa | |
| 6,414,663 | B1 | | 7/2002 | Manross | |
| 6,463,703 | B1 | * | 10/2002 | Mattis | 52/103 |
| 6,904,721 | B1 | * | 6/2005 | Forbes | 52/103 |
| 2004/0085337 | A1 | | 5/2004 | Shahani | |
| 2004/0139633 | A1 | | 7/2004 | Shannon | |
| 2005/0144821 | A1 | * | 7/2005 | Griesemer et al. | 40/546 |

FOREIGN PATENT DOCUMENTS

| | | | |
|---|---|---|---|
| FR | 2681624 | * | 3/1993 |
| JP | 2004-100419 | * | 4/2004 |

* cited by examiner

*Primary Examiner*—William L. Miller
(74) *Attorney, Agent, or Firm*—Reed Smith LLP

(57) ABSTRACT

A combination memorial and columbarium having a headstone, and a base supporting the headstone. At least one chamber for holding a cremation urn and/or the cremated remains of an individual is formed either in the headstone or the base. The chamber has an opening which is sealed either permanently or with a removable seal. In certain embodiments, the chamber is located in the headstone, and the opening may be plugged with a removable seal, or the opening may be sealed by the base of the monument. In another embodiment, the chamber is formed in the base, and the bottom portion of the headstone forms the seal for the chamber when the headstone is placed on the base. In an embodiment of the invention, one deceased person is interned in the earth ahead of the headstone, and the cremated remains of another deceased are secured in the chamber. The chamber may also be adapted to hold a DNA sample of the cremated individual for future family medical reference.

5 Claims, 3 Drawing Sheets

COMBINED HEADSTONE AND COLUMBARIUM

BACKGROUND OF THE INVENTION

1. Field of the Invention

The present invention relates to memorial park monument, and more particularly to a memorial monument comprising a combined burial headstone and base, where either the headstone or the base includes a columbarium compartment adapted to hold an urn, tube or other container-like structure encasing the cremated remains of a deceased person, or other formerly living creatures. The combination of the present invention contemplates that at least one person will be interned in the ground ahead of the monument, while the remains of another person or formerly living creature are maintained in the urn or tube.

The present invention provides a solution to the problem that arises when one or more family members desire to be buried through internment, while other family members desire to be cremated, and all family members desire to lie in their eternal rest in the same plot of land.

2. Prior Art

Previously, grave monuments have been created for the purpose of a headstone marking the location of an individual interned in the earth ahead of the monument, with recessed or cut-out portions in the monument to display items such as flowers, photographs, memorabilia of the deceased, and even video displays describing salient features of the life of the deceased.

In addition, columbaria of various constructions provide a resting place for urns holding the cremated remains of a deceased loved one. These columbaria normally combine shelves in vertical extending walls forming niches for placement of many cremation urns, indoors or outdoors, some having glass covers over the niches so the urn may be viewed. No columbarium has previously been devised that allows the cremation urn of one family member to be placed at or near the resting place of another family member that chose earthen internment.

U.S. Pat. No. 2,124,143 to Long discloses a transparent monument for use as a headstone, having a transparent casting or plate disposed in an opening in the monument. The casting or plate has identifying indicia applied thereto. There is no teaching in the Long patent of lodging the cremated remains of an individual in the monument structure.

U.S. Pat. No. 5,546,710 Barry discloses a customized memorial structure comprising recessed portions formed in the front wall of the monument. The Barry patent indicates that these recesses could be used to contain items such as molded figures, sports objects, and pet likenesses. There is no teaching in the Barry patent that the monument can be constructed to commemorate the lives of two individuals, one cremated whose remains are lodged in the monument, and one who chose earthen internment.

U.S. Pat. No. 6,076,292 to Kawa discloses a cremains container that extends above the ground to provide a grave marker identifying the cremated individual. The cremains container can also hold memorabilia of the deceased. In the Kawa patent, the marker only identifies the single cremated remains. This patent does not teach a monument for identifying the deceased individuals, one whose cremated remains are disposed in the monument, and the other whose remains were interned in the earth.

U.S. Design Pat. No. D89,766 to Hull discloses a burial monument with a compartment for removably holding a portrait and vases. There is no disclosure in the Hull reference that the monument comprises structure to securely house the cremated remains of one individual who is identified on the monument, and to identify a second individual who chose earthen internment with the monument holding the cremated remains also functioning as a headstone identifying the second individual.

As a review of the prior art reveals, monuments or headstones that mark the eternal resting place of two individuals, the monument holding the cremated remains of one individual in the monument and identifying both the cremated and earthen interned individual adjacent to the monument, art not found in the prior art.

SUMMARY OF THE INVENTION

In accordance with the present invention, a monument comprising a combination headstone and base is provided to mark the resting place of one who is earthen interned, and to also hold the remains of another who chose to be cremated. The single monument comprises indicia identifying the names and other selected information of both of the deceased. The monument includes a chamber in which the cremated remains of one individual are placed, and then the chamber is sealed, if desired, to secure the cremated remains in the monument structure to prevent destruction of the cremated remains by acts of vandalism. The seal may also be removable, with a lock system providing access to the chamber only by loved ones.

These and other novel features and advantages of the present invention will be more readily understood from the following detailed description read in association with the accompanying drawings.

BRIEF DESCRIPTION OF THE DRAWINGS

The invention may take various forms, embodiments and arrangements. The drawings are for the sole purpose of illustrating various embodiments of the invention, and are not to be construed as limiting the invention defined in the claims.

DETAILED DESCRIPTION OF THE ILLUSTRATED EMBODIMENTS

FIG. I discloses a monument 10 of the type typically used to memorialize or mark a burial site. The monument 10 includes a base 12 supporting a headstone 14 as is known in the monument art.

Figure 1:
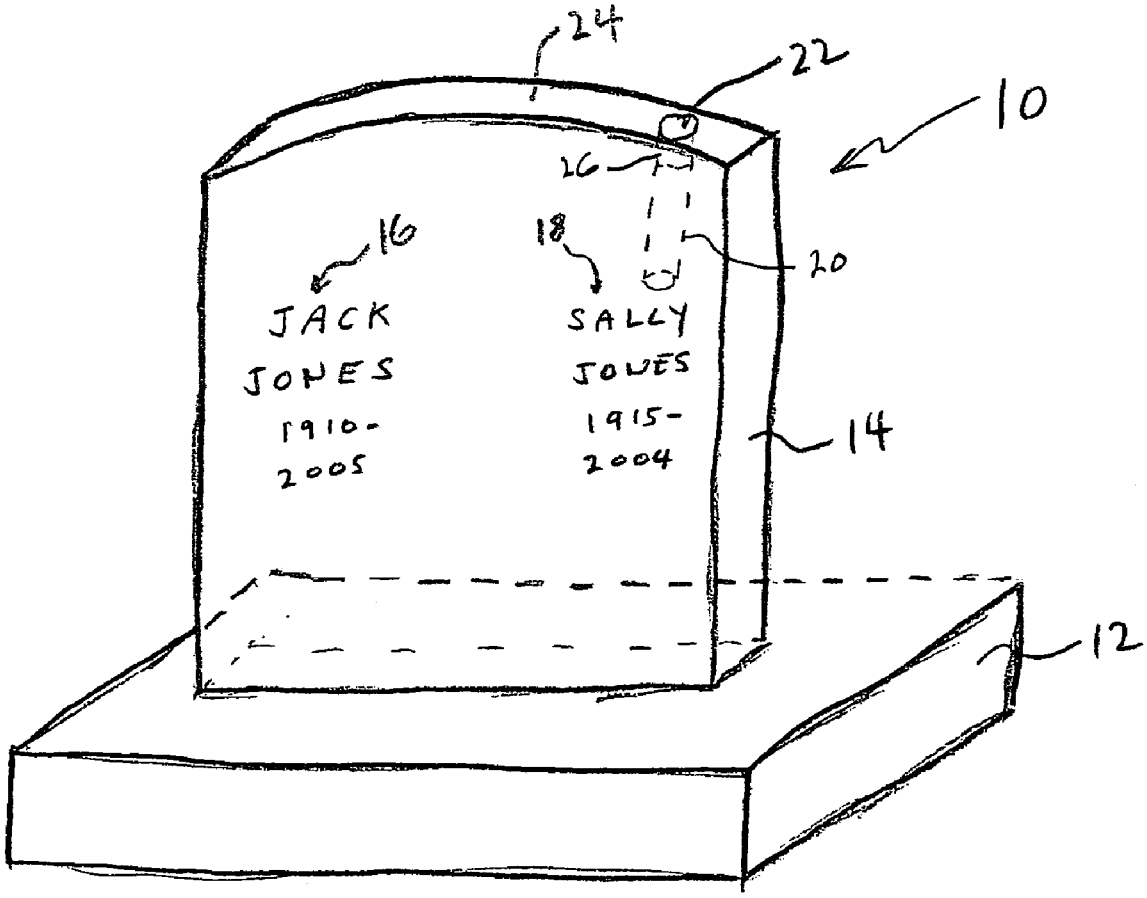
FIG. 1 is a perspective view of a memorial monument in accordance with the present invention, illustrating a chamber for holding the cremated remains of a deceased at the top of the headstone forming the monument.

In the embodiment shown in FIG. 1, the headstone 14 includes the names 16, 18 of two deceased individuals whose lives are memorialized by the monument. The deceased person identified by the name 16 on the left side of the headstone 14, as viewed in FIG. 1, is interned or buried in the earth ahead of the monument 10. The second person whose name 18 appears on the monument has been cremated.

To accommodate the cremated remains of the second deceased person, or additional cremated remains, the monument 10 in the embodiment of FIG. 1 includes at least one chamber or receptacle 20 formed in an inner portion of the headstone 14, the chamber 20 having an opening 22 at the top or upper portion 24 of the headstone. In the illustrated embodiment of FIG. 1, a tightly fitting removable cap or seal 26 extends into passage 20 to seal the chamber 20 as will be explained. In the embodiment of FIG. 1, the chamber 20 is cylindrical in shape, but it is understood that chamber 20 may be of other configurations such as square, rectangular, or the like. Also, as indicated above, more than one chamber 20 may be formed in monument 10, if desired.

The chamber 20, in an embodiment, is dimensioned to hold a crematory urn (not shown). Alternatively, the chamber 20 can be dimensioned to hold the ashes of a cremated deceased person without an urn.

The upper portion of chamber 20 adjacent the top portion 24 of headstone 14 is accessible for placement of a crematory urn or ashes into chamber 20. Once the urn or ashes are placed in chamber 20, cap or seal 26 is inserted into the top of chamber 20. In an embodiment, cap 26 can be force fit into the top of chamber so that the cap cannot be removed, other than drilling out the cap 26. In this embodiment, the urn and/or cremated remains are permanently lodged in chamber 20.

In an alternate embodiment, the cap or seal 26 is removably inserted into the opening 22 of chamber 20 after the cremated remains are placed in chamber 20, to allow the crematory urn or cremated remains to be removed by a family member if desired. In this embodiment, the invention contemplates that cap or seal 26 will engage the inner walls of chamber 20 through a sturdy lock and key system, or equivalent security system, to prevent unwanted removal of cap or seal 26 by vandals or the like.

Figure 2:
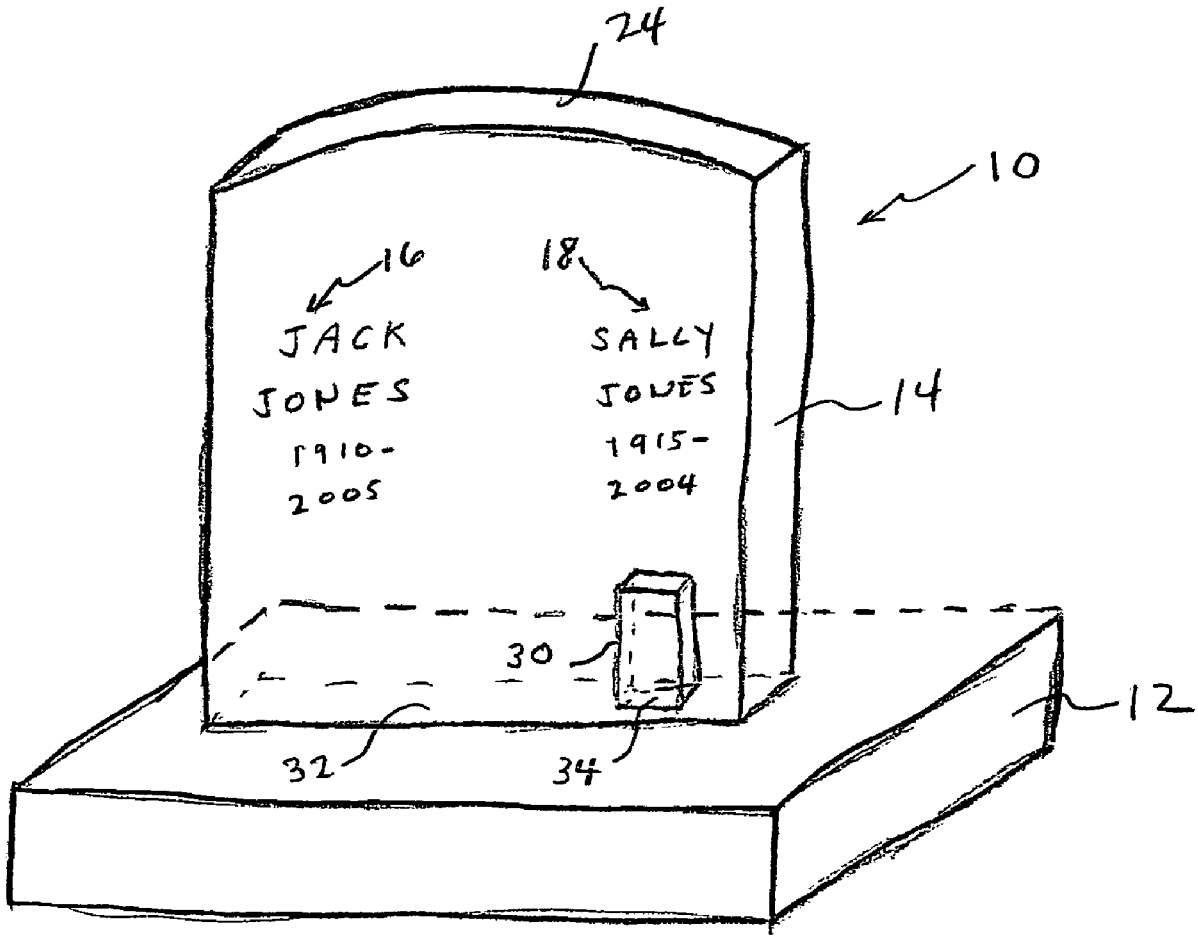
FIG. 2 is a perspective view of a memorial monument in accordance with the present invention, wherein the chamber for holding the cremated remains of a deceased is at a lower portion of the headstone and just above the base of the monument.

FIG. 2 shows an alternate embodiment of the present invention, wherein like elements shown in FIG. 1 are identified by the same numerals. In the embodiment of FIG. 2, one chamber 30, or possibly multiple chambers 30, are located in the bottom inner portion 32 of headstone 14, and each chamber 30 has an opening 34 providing access from bottom portion 32 of headstone 14 into chamber 30. In this embodiment, chamber 30 is shown in a rectangular shape compared to the cylindrical shape of chamber 20 in FIG. 1. However, in keeping within the scope of the present invention, chamber 30 may be any suitable shape.

Referring to FIG. 2, in use, a crematory urn (not shown), or the cremated remains of a deceased, are inserted into chamber 30 prior to headstone 14 being assembled onto base 12. Normally, the weight of headstone 14 will provide a seal at opening 34 of chamber 30, keeping the cremated remains secure in the chamber. If desired, a cap or seal 26 such as shown in FIG. 1 can be inserted and locked into position at opening 34 just after the cremated remains are placed into chamber 30. In addition, if desired a latching mechanism (not shown) can be placed between headstone 14 and base 12, preventing access to the contents of chamber 30 in case of acts of vandalism.

Figure 3:
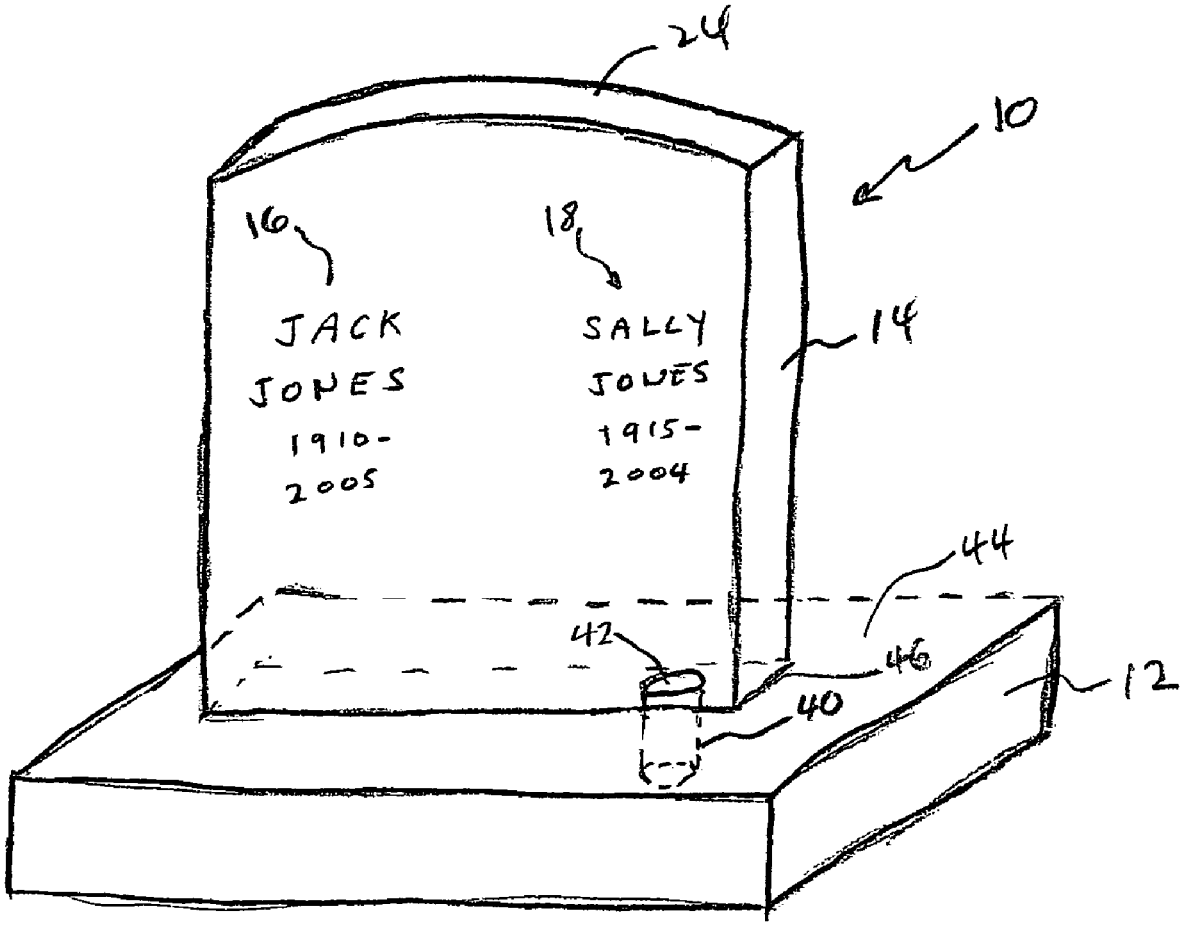
FIG. 3 is a perspective view of a memorial monument in accordance with the present invention, wherein the chamber for holding the cremated remains of a deceased is in the base of the monument.

In the embodiment of FIG. 3, wherein like elements shown in FIGS. 1 and 2 are identified by the same numerals, one or more chambers 40 are located in an inner portion of the base 12. An opening 42 in the upper portion 44 of base 12 provides access to chamber 40. The chamber 40 is shown as having a cylindrical shape, but can be of any suitable shape to hold a crematory urn or the cremated remains of a deceased, as desired.

In the embodiment of FIG. 3, an urn containing the cremated remains of a deceased, or the cremated remains, are placed in chamber 40 before headstone 14 is mounted and fixed in place on base 12. When the headstone 14 is mounted on the base 12, the bottom of headstone 46 covers and seals opening 42 and chamber 40 with the cremated remains securely lodged in chamber 40. The various chambers 20, 30 and 40 of FIGS. 1-3 can also be adapted to hold a DNA sample of the cremated individual for possible medical use by other family members. In such case, it is contemplated that the respective chamber will be accessible.

As is apparent, the various embodiments of the present invention provide a combination memorial park monument comprising a headstone and base, and including a chamber for the secure placement of the cremated remains of a deceased individual. The monument 10, therefore, allows two, or more if desired, deceased individuals to lie together in their eternal resting place in situations where one or more persons desire to be interned in the earth at the end of their days, and one or more persons in loving relationship with the other or others decide upon cremation of their earthly form.

The foregoing description of embodiments of the invention has been presented for purposes of illustration and description, and is not intended to be exhaustive or to limit the invention to the precise forms disclosed. The description was selected to best explain the principles of the invention and practical application of these principle to enable others skilled in the art to best utilize the invention in various embodiments and various modifications as are suited to the particular use contemplated. It is intended that the scope of the invention not be limited by the specification, but be defined by the claims set forth below.

I claim:

1. A combination memorial and columbarium for marking a burial site and for holding cremated remains of a deceased person; comprising:

a. a headstone for marking the burial site, said headstone having a top surface and a planar bottom surface;

b. an above ground base supporting the bottom surface of the headstone;

c. at least one chamber formed in an interior portion of said headstone;

d. the at least one chamber formed to include opposing first and second ends, the first end being permanently closed, and the second end having an opening providing access to said at least one chamber, said opening communicating with said bottom surface of said headstone;

e. said base sealing said opening when said headstone is supported by said base;

f. the at least one chamber adapted to securely hold the cremated remains of the deceased person; and g. the at least one chamber hidden from view until said headstone is moved relative to said base.

2. The combination memorial and columbarium of claim 1, further including a removable seal in the opening of the at least one chamber, the removable seal preventing access to the at least one chamber when the seal is disposed in the opening.

3. The combination memorial and columbarium of claim 1 wherein said base includes a top portion, and said top portion of said base provides said seal over the at least one chamber.

4. A combination memorial and columbarium for marking a burial site and for holding cremated remains of a deceased individual, comprising:

a. a headstone for marking the burial site, the headstone having a top surface and a planar bottom surface, the headstone including indicia identifying at least two deceased individuals, one of said at least two individuals provided with an earthen internment and the other of said at least two individuals provided with cremation;

b. an above ground base supporting the bottom surface of the headstone;

c. at least one chamber formed in an interior portion of said headstone, said at least one chamber adapted to hold the cremated remains of said individual provided with cremation;

d. the chamber having an opening providing access to said at least one chamber, said opening communicating with said bottom surface of said headstone; and e. said base sealing said opening when said headstone is supported by said base;

f. a seal for said opening, said seal preventing access to the at least one chamber.

5. The combination memorial and columbarium of claim 4 wherein said seal is removable.

* * * * *